US006295799B1

(12) United States Patent
Baranda

(10) Patent No.: US 6,295,799 B1
(45) Date of Patent: Oct. 2, 2001

(54) TENSION MEMBER FOR AN ELEVATOR

(75) Inventor: Pedro S. Baranda, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/406,453

(22) Filed: Sep. 27, 1999

(51) Int. Cl.[7] ..... D07B 1/06
(52) U.S. Cl. ..... 57/221; 51/218; 51/210
(58) Field of Search ..... 57/250, 210, 211, 57/212, 218, 232, 237, 221; 187/251, 261, 411

(56) References Cited

U.S. PATENT DOCUMENTS

| | | | | |
|---|---|---|---|---|
| 975,790 | | 11/1910 | Pearson . | |
| 1,011,423 | | 12/1911 | Gale, Sr. . | |
| 1,035,230 | | 8/1912 | Pearson . | |
| 1,164,115 | | 12/1915 | Pearson . | |
| 3,885,380 | * | 5/1975 | Hacker | 257/231 |
| 4,022,010 | * | 5/1977 | Gladenbeck et al. | 57/231 |
| 4,059,951 | * | 11/1977 | Roe | 57/230 |
| 4,388,837 | | 6/1983 | Bender | 74/89.2 |
| 4,514,466 | * | 4/1985 | Leon, Jr. et al. | 428/383 |
| 4,519,262 | | 5/1985 | Le et al. | 74/89.2 |
| 4,550,559 | * | 11/1985 | Thomson | 57/223 |
| 4,887,422 | * | 12/1989 | Klees et al. | 57/220 |
| 5,112,933 | | 5/1992 | O'Donnell et al. | 528/61 |
| 6,164,053 | * | 12/2000 | O'Donnell et al. | 57/232 |

FOREIGN PATENT DOCUMENTS

| | | |
|---|---|---|
| 2333120 | 1/1975 | (DE) . |
| 1362514 | 8/1974 | (GB) . |
| 1401197 | 7/1975 | (GB) . |
| 1216120A | 7/1986 | (SU) . |
| WO9829326 | 7/1998 | (WO) . |
| WO9829327 | 7/1998 | (WO) . |

* cited by examiner

*Primary Examiner*—Danny Worrell

(57) ABSTRACT

A tension member for an elevator system has an aspect ratio of greater than one, where aspect ratio is defined as the ratio of tension member width w to thickness t (w/t). The increase in aspect ratio results in a reduction in the maximum rope pressure and an increased flexibility as compared to conventional elevator ropes. As a result, smaller sheaves may be used with this type of tension member. In a particular embodiment, the tension member includes a plurality of individual load carrying cords encased within a common layer of coating. The coating layer separates the individual cords and defines an engagement surface for engaging a traction sheave. The individual cords are constructed of several strands and each strand is separated from direct contact with each other strand by polymeric material. While aspect ratios of greater than one are preferred, tension members of other ratios including round also benefit from the prevention of direct contact.

16 Claims, 6 Drawing Sheets

TENSION MEMBER FOR AN ELEVATOR

BACKGROUND OF THE INVENTION

1. Technical Field

The present invention relates to elevator systems, and more particularly to tension members for such elevator systems.

2. Prior Art

A conventional traction elevator system includes a car, a counterweight, two or more ropes interconnecting the car and counterweight, a traction sheave to move the ropes, and a machine to rotate the traction sheave. The ropes are formed from laid or twisted steel wire and the sheave is formed from cast iron. The machine may be either a geared or gearless machine. A geared machine permits the use of higher speed motor, which is more compact and less costly, but requires additional maintenance and space.

Although conventional round steel ropes and cast iron sheaves have proven very reliable and cost effective, there are limitations on their use. One such limitation is the traction forces between the ropes and the sheave. These traction forces may be enhanced by increasing the wrap angle of the ropes or by undercutting the grooves in the sheave. Both techniques reduce the durability of the ropes, however, as a result of the increased wear (wrap angle) or the increased rope pressure (undercutting). Another method to increase the traction forces is to use liners formed from a synthetic material in the grooves of the sheave. The liners increase the coefficient of friction between the ropes and sheave while at the same time minimizing the wear of the ropes and sheave.

Another limitation on the use of round steel ropes is the flexibility and fatigue characteristics of round steel wire ropes. Elevator safety codes today require that each steel rope have a minimum diameter d ($d_{min}$=8 mm for CEN; $d_{min}$=9.5 mm (⅜") for ANSI) and that the D/d ratio for traction elevators be greater than or equal to forty ($D/d \geqq 40$), where D is the diameter of the sheave. This results in the diameter D for the sheave being at least 320 mm (380 mm for ANSI). The larger the sheave diameter D, the greater torque required from the machine to drive the elevator system.

Another drawback of conventional round ropes is that the higher the rope pressure, the shorter the life of the rope. Rope pressure ($P_{rope}$) is generated as the rope travels over the sheave and is directly proportional to the tension (F) in the rope and inversely proportional to the sheave diameter D and the rope diameter d ($P_{rope} \approx F/(Dd)$). In addition, the shape of the sheave grooves, including such traction enhancing techniques as undercutting the sheave grooves, further increases the maximum rope pressure to which the rope is subjected.

The above art notwithstanding, scientists and engineers under the direction of Applicants' Assignee are working to develop more efficient and durable methods and apparatus to drive elevator systems.

SUMMARY OF THE INVENTION

According to the present invention, a preferred tension member for an elevator has an aspect ratio of greater than one, where aspect ratio is defined as the ratio of tension member width w to thickness t (Aspect Ratio=w/t). In another aspect of the invention ropes other than flat ropes (such as round ropes) are benefited by one of the configurations of the invention.

A feature of one embodiment of the present invention is the flatness of the tension member. The increase in aspect ratio results in a tension member that has an engagement surface, defined by the width dimension, that is optimized to distribute the rope pressure. Therefore, the maximum pressure is minimized within the tension member. In addition, by increasing the aspect ratio relative to a round rope, which has an aspect ratio equal to one, the thickness of the tension member may be reduced while maintaining a constant cross-sectional area of the tension member.

According further to the present invention, the tension member includes a plurality of individual load carrying cords encased within a common layer of coating. The coating layer separates the individual cords and defines an engagement surface for engaging a traction sheave.

Due to the configuration of the tension member, the rope pressure may be distributed more uniformly throughout the tension member. As a result, the maximum rope pressure is significantly reduced as compared to a conventionally roped elevator having a similar load carrying capacity. Furthermore, the effective rope diameter 'd' (measured in the bending direction) is reduced for the equivalent load bearing capacity. Therefore, smaller values for the sheave diameter 'D' may be attained without a reduction in the D/d ratio. In addition, minimizing the diameter D of the sheave permits the use of less costly, more compact, high speed motors as the drive machine without the need for a gearbox.

In a particular embodiment of the present invention, the individual cords are formed from strands of metallic material, organic fiber material or a combination of both. By incorporating cords having the weight, strength, durability and, in particular, the flexibility characteristics of appropriately sized and constructed materials into the tension member of the present invention, the acceptable traction sheave diameter may be further reduced while maintaining the maximum rope pressure within acceptable limits. As stated previously, smaller sheave diameters reduce the required torque of the machine driving the sheave and increase the rotational speed. Therefore, smaller and less costly machines may be used to drive the elevator system.

In order to further enhance tension member service life, the individual cords employed in the invention are treated to avoid fretting. This treatment occurs at two levels. First, the outer strands use wires that are more narrow than the central strand. Because of this difference, a gap is formed between the outer strands. The rope jacket when being formed around the desired number of cords therefore penetrates into the gap between the outer strands to a sufficient degree to prevent strand-to-strand contact and avoid fretting. This is effective and provides for a long flexible tension member service life. It is also a teaching of the invention however, to provide an even longer life or higher weight rated tension member. To this end, the invention teaches to provide a polymer jacket around the central strand in each cord before the outer strands are wound around the central strand. By so doing, contact between the outer strands and the center strand in each cord is diminished and fretting therebetween does not occur. This allows either for a higher weight carrying capacity for the tension member employing this technology or for a longer service life of such tension member. In either case, the industry is substantially benefited. Coating an inner strand in accordance with the invention is applicable to all tension members including but not limited to flat tension members and round tension members. Since flat tension members may be preferred for other reasons the invention is discussed with respect to these. Those of skill in the art will be enabled herefrom to practice the invention on flat or round tension members (or other shape).

Although described herein as primarily a traction device for use in an elevator application having a traction sheave, the tension member may be useful and have benefits in elevator applications that do not use a traction sheave to drive the tension member, such as indirectly roped elevator systems, linear motor driven elevator systems, or self-propelled elevators having a counterweight. In these applications, the reduced size of the sheave may be useful in order to reduce space requirements for the elevator system. The foregoing and other objects, features and advantages of the present invention become more apparent in light of the following detailed description of the exemplary embodiments thereof, as illustrated in the accompanying drawings.

BRIEF DESCRIPTION OF THE DRAWINGS

Referring now to the drawings wherein like elements are numbered alike in the several FIGURES.

BEST MODE FOR CARRYING OUT THE INVENTION

Figure 1:
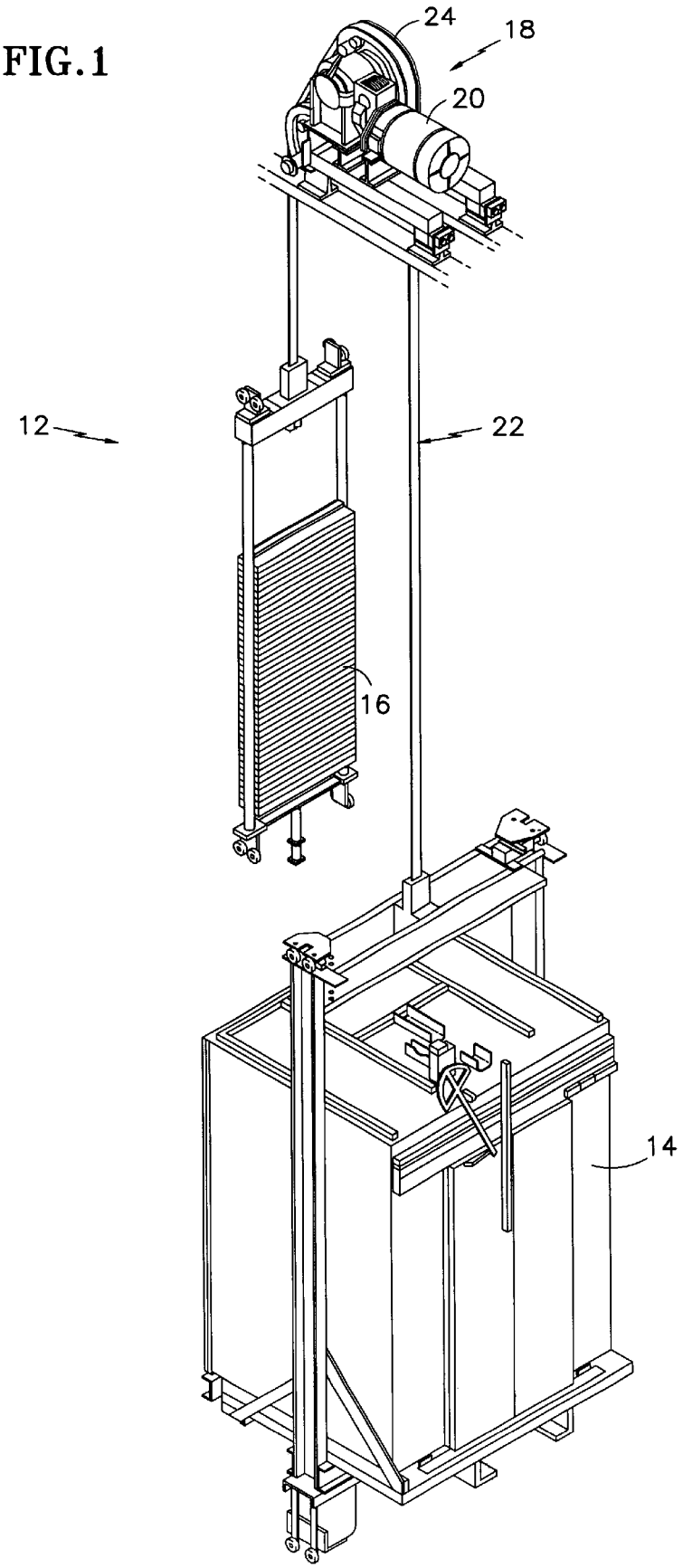
FIG. 1 is a perspective view of an elevator system.

Illustrated in FIG. 1 is a traction elevator system 12. The elevator system 12 includes a car 14, a counterweight 16, a traction drive 18, and a machine 20. The traction drive 18 includes a tension member 22, interconnecting the car 14 and counterweight 16, and a traction sheave 24. The tension member 22 is engaged with the sheave 24 such that rotation of the sheave 24 moves the tension member 22, and thereby the car 14 and counterweight 16. The machine 20 is engaged with the sheave 24 to rotate the sheave 24. Although shown a s a geared machine 20, it should be noted that this configuration is for illustrative purposes only, and the present invention may be used with geared or gearless machines.

Figure 2:
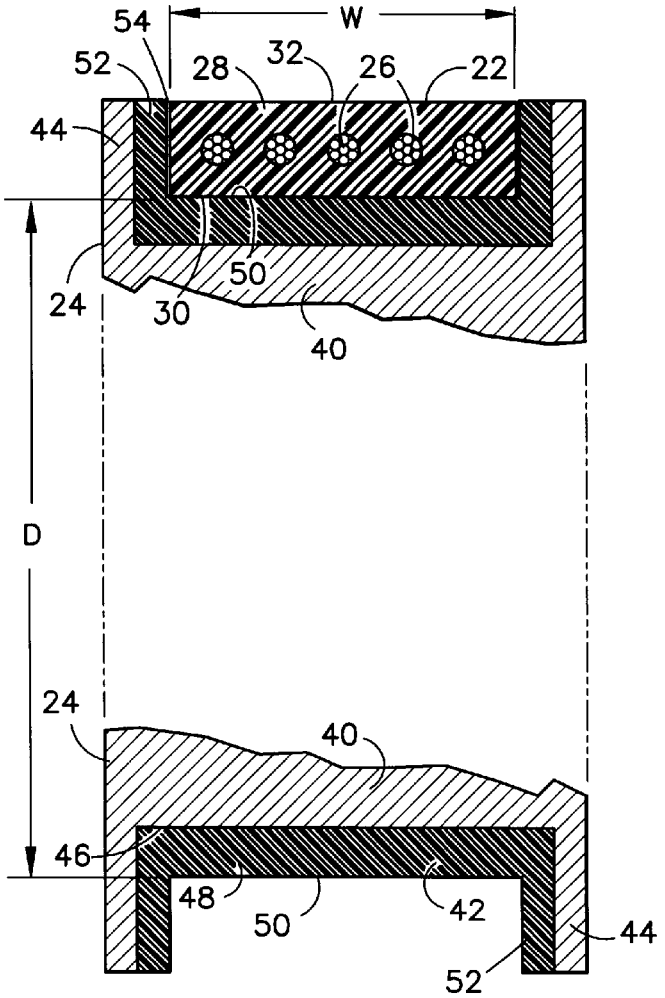
FIG. 2 is a sectional, side view of the traction drive, showing a tension member and a sheave.

The tension member 22 and sheave 24 are illustrated in more detail in FIG. 2. The tension member 22 is a single device that integrates a plurality of cords 26 within a common coating layer 28. Each of the cords 26 is formed from preferably seven twisted strands, each made up of seven twisted metallic wires. In a preferred embodiment of the invention a high carbon steel is employed. The steel is preferably cold drawn and galvanized for the recognized properties of strength and corrosion resistance of such processes. The coating layer is preferably a polyurethane material and may include a fire retardant composition.

Figure 3:
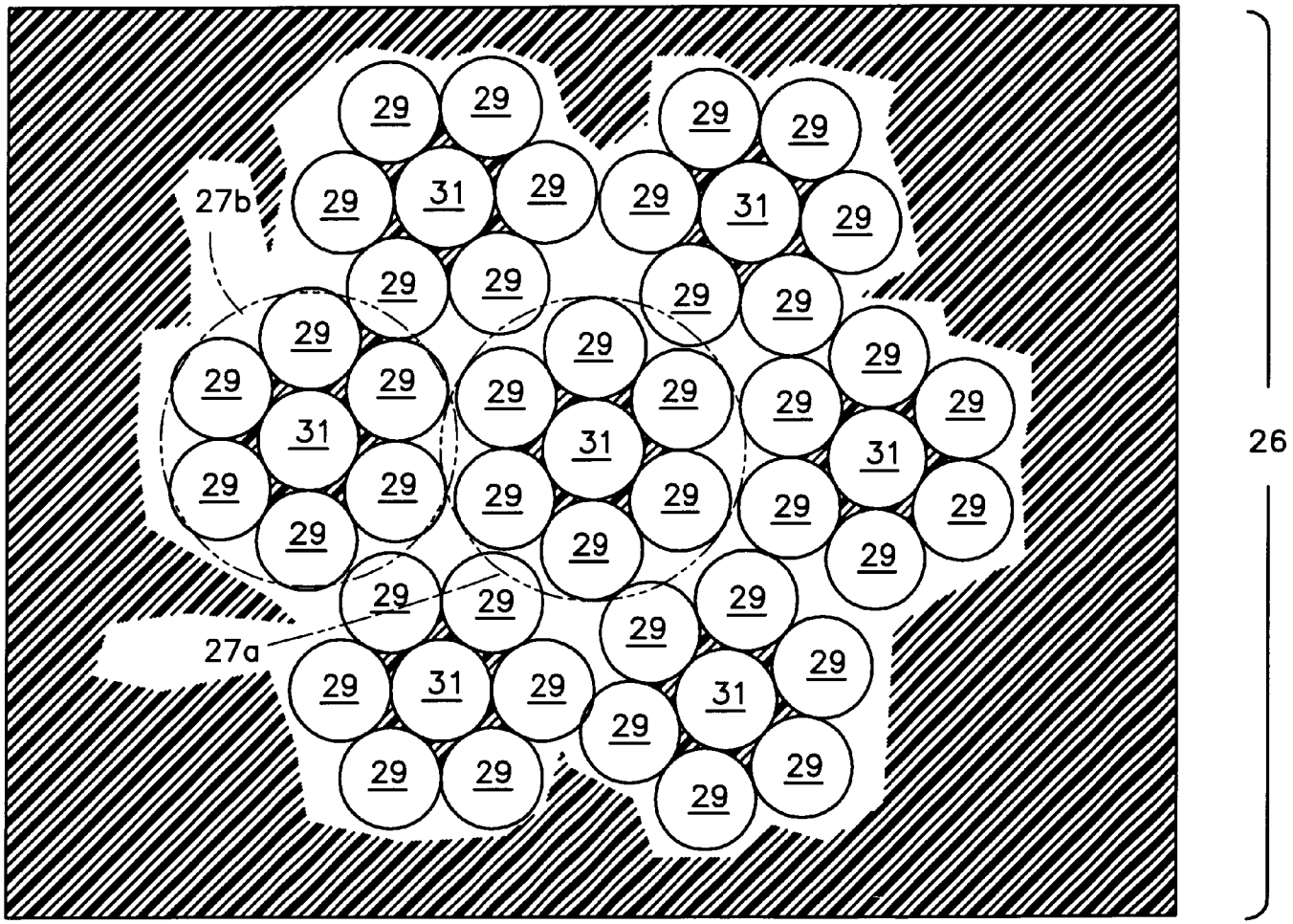
FIG. 3 is a magnified cross sectional view of a single cord of the invention having six strands twisted around a central stand.

In a preferred embodiment, referring to FIG. 3, each strand 27 of a cord 26 comprises seven wires with six of the wires 29 twisted around a center wire 31. Each cord 26, comprises one strand 27*a* which is centrally located and six additional outer strands 27*b* that are twisted around the central strand 27*a*. Preferably, the twisting pattern of the individual wires 29 that form the central strand 27*a* are twisted in one direction around central wire 31 of central strand 27*a* while the wires 29 of outer strands 27*b* are twisted around the central wire 31 of the outer strands 27*b* in the opposite direction. Outer strands 27*b* are twisted around central strand 27*a* in the same direction as the wires 29 are twisted around center wire 31 in strand 27*a*. For example, the individual strands in one embodiment comprise the central wire 31, in center strand 27*a*, with the six twisted wires 29 twisting clockwise; the wires 29 in the outer strands 27*b* twisting counterclockwise around their individual center wires 31 while at the cord 26 level the outer strands 27*b* twist around the central strand 27*a* in the clockwise direction. The directions of twisting improve the characteristics of load sharing in all of the wires of the cord.

It is important to the success of the flat embodiment of the invention to employ wire 29 of a very small size. Each wire 29 and 31 are less than 0.25 millimeters in diameter and preferably are in the range of about 0.10 millimeters to 0.20 millimeters in diameter. In a particular embodiment, the wires are of a diameter of 0.175 millimeters in diameter. The small sizes of the wires preferably employed contribute to the benefit of the use of a sheave of smaller diameter. The smaller diameter wire can withstand the bending radius of a smaller diameter sheave (around 100 millimeters in diameter) without placing too much stress on the strands of the flat rope. Because of the incorporation of a plurality of small cords 26, preferably about 1.6 millimeters in total diameter in this particular embodiment of the invention, into the flat rope elastomer, the pressure on each cord is significantly diminished over prior art ropes. Cord pressure is decreased at least as $n^{-1/2}$ with n being the number of parallel cords in the flat rope, for a given load and wire cross section.

Figure 4:
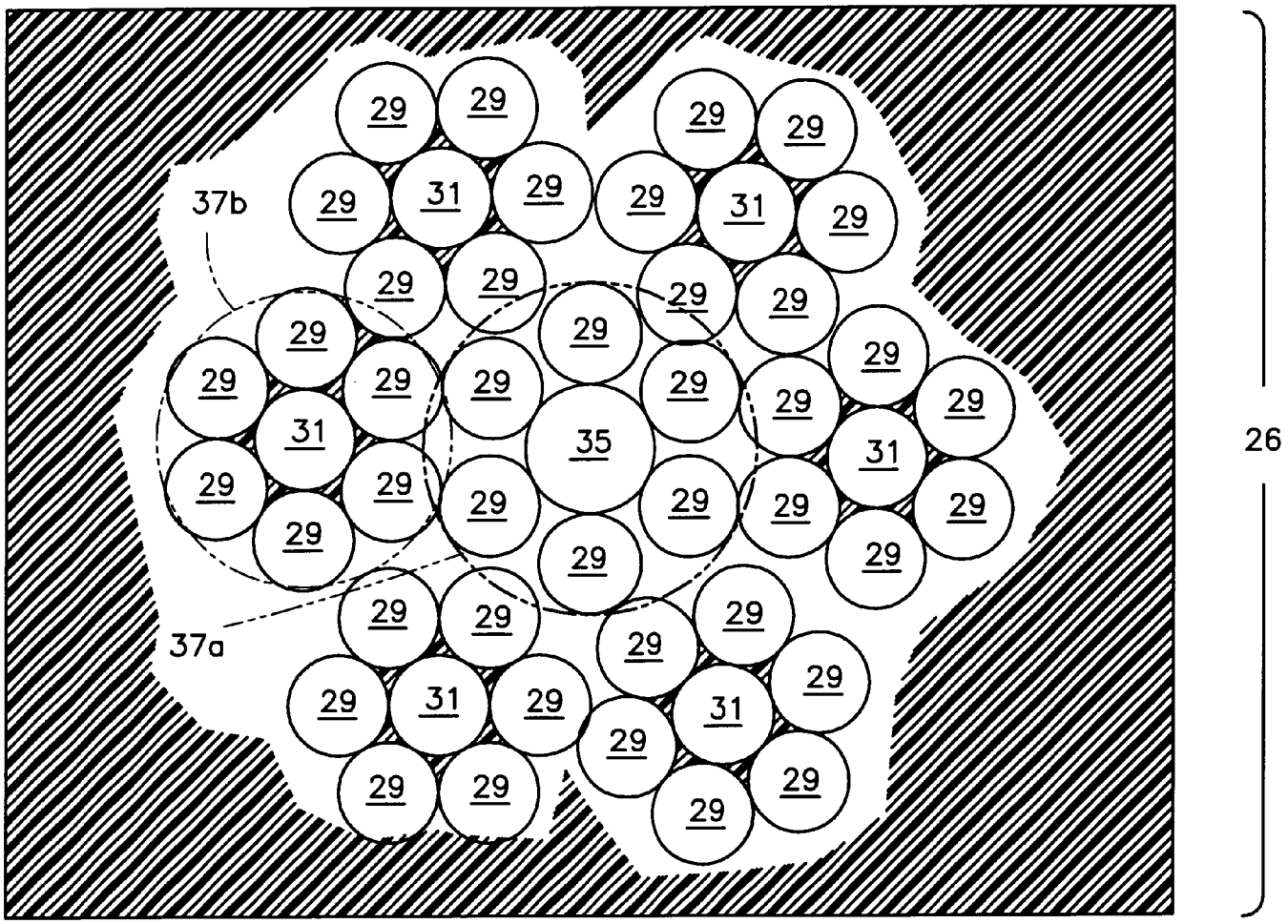
FIG. 4 is a magnified cross sectional view of an alternate single cord of the invention.

In an alternate embodiment, referring to FIG. 4, the center wire 35 of the center strand 37*a* of each cord 26 employs a larger diameter. For example, if the wires 29 of the previous embodiment (0.175 millimeters) are employed, the center wire 35 of the center strand only of all cords would be about 0.20–0.22 millimeters in diameter. The effect of such a center wire diameter change is to reduce contact between wires 29 surrounding wire 35 as well as to reduce contact between strands 37*b* which are twisted around strand 37*a*. In such an embodiment the diameter of cord 26 will be slightly greater than the previous example of 1.6 millimeters.

Figure 5:
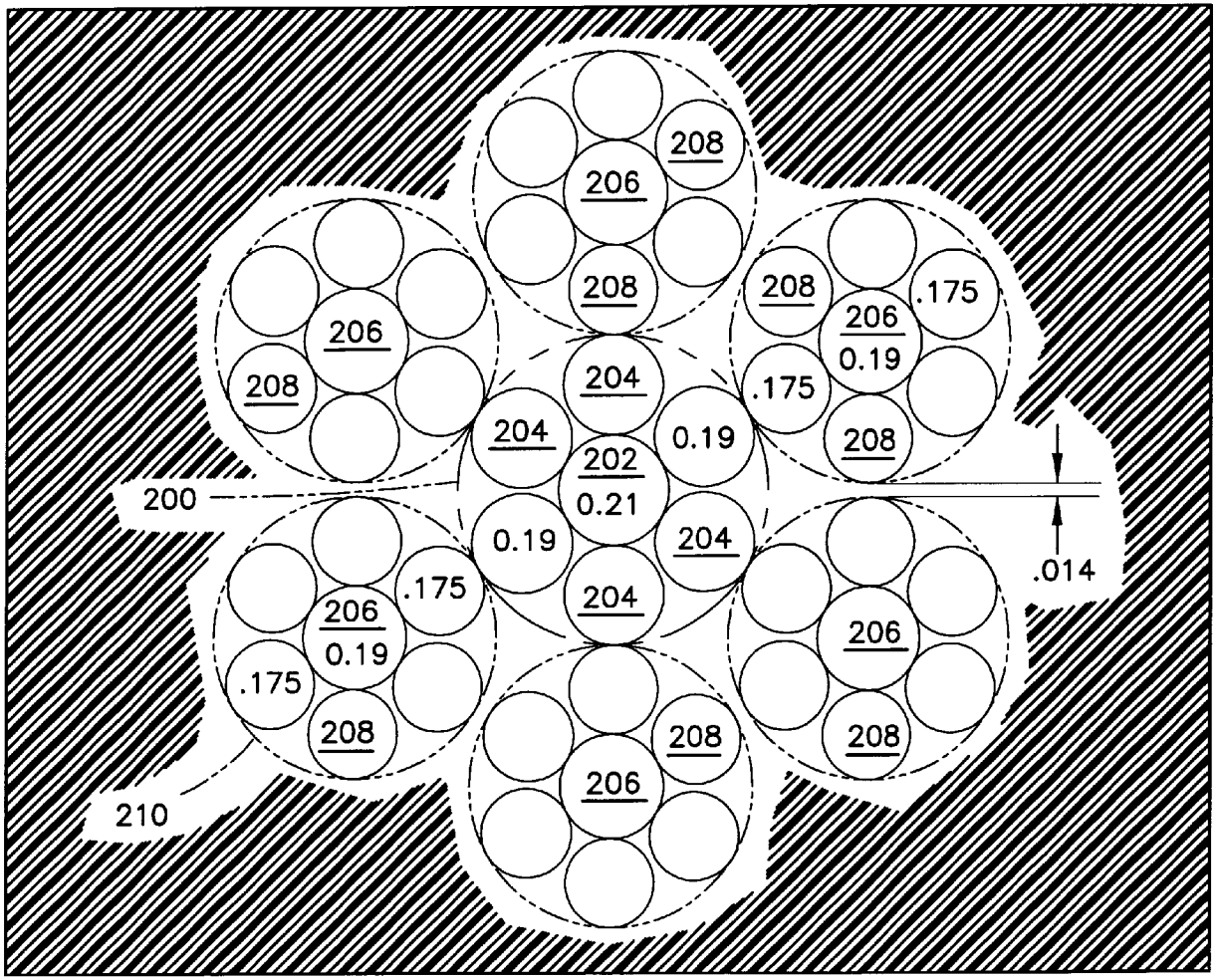
FIG. 5 is a magnified cross sectional view of another alternate embodiment of the invention.

In a third embodiment of the invention, referring to FIG. 5, the concept of the second embodiment is expanded to further reduce wire-to-wire and strand-to-strand contact. Three distinct sizes of wires are employed to construct the cords of the invention. In this embodiment the largest wire is the center wire 202 in the center strand 200. The intermediate diameter wires 204 are located around the center wire 202 of center strand 200 and therefore makeup a part of center strand 200. This intermediate diameter wire 204 is also the center wire 206 for all outer strands 210. The smallest diameter wires employed are numbered 208. These wrap each wire 206 in each outer strand 210. All of the wires in the embodiment are still less than 0.25 mm in diameter. In a representative embodiment, wires 202 may be 0.21 mm; wires 204 may be 0.19 mm; wires 206 may be 0.19 mm; and wires 208 may be 0.175 mm. It will be appreciated that in this embodiment wires 204 and 206 are of equivalent diameters and are numbered individually to provide locational information only. It is noted that the invention is not limited by wires 204 and 206 being identical in diameter. All of the diameters of wires provided are for example only and could be rearranged with the joining principle being that contact among the outer wires of the central strand is reduced; that contact among the outer wires of the outer strands is reduced and that contact among the outer strands is reduced. In the example provided, (only for purpose of example) the space obtained between the outer wires of outer strands is 0.014 mm. This is sufficient for the common coating layer 28 to infiltrate this gap and prevent contact between the outer strands.

Figure 6:
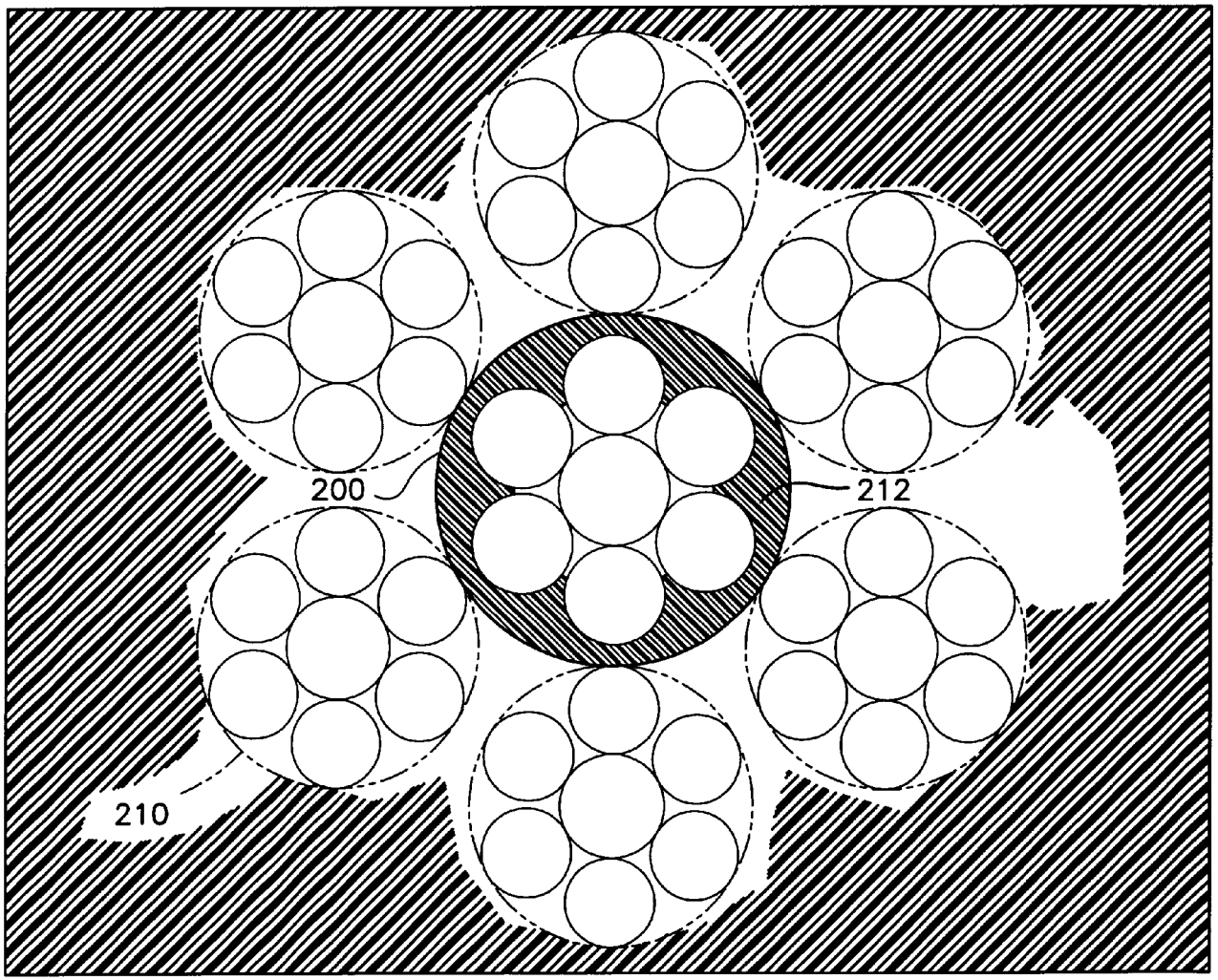
FIG. 6 is a schematic cross sectional view of a single cord having an inner polymeric jacket around the central strand thereof.

While this dramatically increases rope life because of the reduced fretting between outer strands the tension member cords still experience fretting between the outer strands and the center strand where contact is made. Avoiding fretting in this location can further enhance service life or allow both flat tension members and non-flat tension members to be rated for higher loads. Referring to FIG. 6 the central strand 200 is precoated with a polymer jacket 212 prior to winding outer strands 210 therearound. The polymer jacket 212 may be formed as an extrusion of a thermoplastic material or by pre-impregnating and curing a thermoset material such as typical rubber products. Employing a polyurethane or other material compatible with the common coating layer 28 enables the melting of the polymer jacket 212 into engagement with the common coating layer 28. This is one preferred embodiment of the invention. In another preferred embodiment of the invention a modified polyamide or a polyacetal low friction material may be employed as the polymer jacket 212. Such low friction materials provide internal lubrication to the individual cords and ultimately producing a tension member having significantly improved service life or the capacity for a higher weight rating. It should be noted that although jacket 212 has been described as used in a cord having different wire and strand diameters, the concept of the jacket 212 is fully utilizable with any of the other cord embodiments described herein.

The cords 26 are equal length, are approximately equally spaced widthwise within the coating layer 28 and are arranged linearly along the width dimension. The coating layer 28 is formed from a polyurethane material, preferably a thermoplastic urethane, that is extruded onto and through the plurality of cords 26 in such a manner that each of the individual cords 26 is restrained against longitudinal movement relative to the other cords 26. Transparent material is an alternate embodiment which may be advantageous since it facilitates visual inspection of the flat rope. Structurally, of course, the color is irrelevant. Other materials may also be used for the coating layer 28 if they are sufficient to meet the required functions of the coating layer: traction, wear, transmission of traction loads to the cords 26 and resistance to environmental factors. It should further be understood that if other materials are used which do not meet or exceed the mechanical properties of a thermoplastic urethane, then the additional benefit of the invention of dramatically reducing sheave diameter may not be fully achievable. With the thermoplastic urethane mechanical properties the sheave diameter is reducible to 100 millimeters or less. The coating layer 28 defines an engagement surface 30 that is in contact with a corresponding surface of the traction sheave 24.

Figure 7:
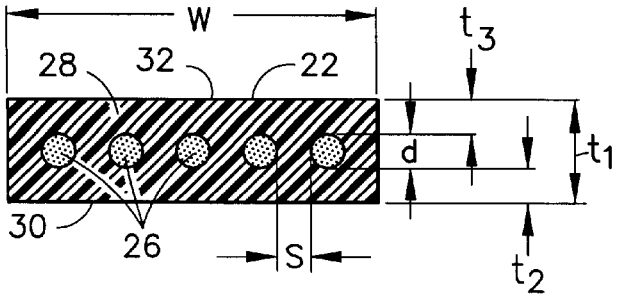
FIG. 7 is a schematic cross sectional view of a flat rope to illustrate various dimensional characteristics thereof.

As shown more clearly in FIG. 7, the tension member 22 has a width w, measured laterally relative to the length of the tension member 22, and a thickness t1, measured in the direction of bending of the tension member 22 about the sheave 24. Each of the cords 26 has a diameter d and are spaced apart by a distance s. In addition, the thickness of the coating layer 28 between the cords 26 and the engagement surface 30 is defined as t2 and between the cords 26 and the opposite surface is defined as t3, such that t1=t2+t3+d.

The overall dimensions of the tension member 22 results in a cross-section having an aspect ratio of much greater than one, where aspect ratio is defined as the ratio of width w to thickness t1 or (Aspect Ratio=w/t1). An aspect ratio of one corresponds to a circular cross-section, such as that common in conventional round ropes. The higher the aspect ratio, the more flat the tension member 22 is in cross-section. Flattening out the tension member 22 minimizes the thickness t1 and maximizes the width w of the tension member 22 without sacrificing cross-sectional area or load carrying capacity. This configuration results in distributing the rope pressure across the width of the tension member 22 and reduces the maximum rope pressure relative to a round rope of comparable cross-sectional area and load carrying capacity. As shown in FIG. 2, for the tension member 22 having five individual cords 26 disposed within the coating layer 28, the aspect ratio is greater than five. Although shown as having an aspect ratio greater than five, it is believed that benefits will result from tension members having aspect ratios greater than one, and particularly for aspect ratios greater than two.

The separation s between adjacent cords 26 is dependant upon the materials and manufacturing processes used in the tension member 22 and the distribution of rope stress across the tension member 22. For weight considerations, it is desirable to minimize the spacing s between adjacent cords 26, thereby reducing the amount of coating material between the cords 26. Taking into account rope stress distribution, however, may limit how close the cords 26 may be to each other in order to avoid excessive stress in the coating layer 28 between adjacent cords 26. Based on these considerations, the spacing may be optimized for the particular load carrying requirements.

The thickness t2 of the coating layer 28 is dependant upon the rope stress distribution and the wear characteristics of the coating layer 28 material. As before, it is desirable to avoid excessive stress in the coating layer 28 while providing sufficient material to maximize the expected life of the tension member 22.

The thickness t3 of the coating layer 28 is dependent upon the use of the tension member 22. As illustrated in FIG. 1, the tension member 22 travels over a single sheave 24 and therefore the top surface 32 does not engage the sheave 24. In this application, the thickness t3 may be very thin, although it must be sufficient to withstand the strain as the tension member 22 travels over the sheave 24. It may also be desirable to groove the tension member surface 32 to reduce tension in the thickness t3. On the other hand, a thickness t3 equivalent to that of t2 may be required if the tension member 22 is used in an elevator system that requires reverse bending of the tension member 22 about a second sheave. In this application, both the upper 32 and lower surface 30 of the tension member 22 is an engagement surface and subject to the same requirement of wear and stress. It is preferred for either application to groove the lower surface 30 for traction.

The diameter d of the individual cords 26 and the number of cords 26 is dependent upon the specific application. It is desirable to maintain the thickness d as small as possible, as hereinbefore discussed, in order to maximize the flexibility and minimize the stress in the cords 26.

Although the invention has been shown and described with respect to exemplary embodiments thereof, it should be understood by those skilled in the art that various changes, omissions, and additions may be made thereto, without departing from the spirit and scope of the invention.

What is claimed is:

1. A tension member for an elevator system, said tension member being substantially rectangular in cross section and having a width and a thickness, said tension member comprising:

a plurality of cords, said cords being substantially parallel and spaced approximately evenly across the width of said tension member, each of said cords comprising:

(a) a plurality of wires twisted into a center strand;

(b) a polymeric inner coating encasing said center strand; and (c) a second plurality of wires twisted into a plurality of outer strands, said strands being twisted around said polymeric inner coating of said center strand; and a polymeric common coating encasing said plurality of cords.

2. The tension member as claimed in claim 1 wherein said plurality of cords is arranged linearly across the width of said tension member.

3. The tension member according to claim 1 wherein said plurality of wires formed into said center strand comprises:

a center wire; and a plurality of outer wires.

4. The tension member according to claim 3 wherein said plurality of outer wires is wrapped around said center wire.

5. The tension member according to claim 3 wherein said center wire of said center strand is about 0.21 mm in diameter and each of said plurality of outer wires of said center strand is about 0.19 mm in diameter.

6. The tension member according to claim 1 wherein said second plurality of wires formed into said plurality of outer strands comprises:

a center wire for each of said plurality of outer strands; and a plurality of outer wires for each of said plurality of outer strands.

7. The tension member according to claim 6 wherein for each of said plurality of outer strands said plurality of outer wires is wrapped around said center wire.

8. The tension member according to claim 6 wherein said center wire of each of said outer strands is about 0.19 mm in diameter.

9. The tension member according to claim 6 wherein said outer wires of each of said outer strands are each about 0.175 mm in diameter.

10. The tension member according to claim 1 wherein said polymeric inner coating encasing said center strand is polyurethane.

11. The tension member according to claim 1 wherein said polymeric inner coating encasing said center strand is polyamide.

12. The tension member according to claim 1 wherein said polymeric inner coating encasing said center strand is polyacetal.

13. The tension member according to claim 1 wherein said polymeric inner coating encasing said center strand reduces contact between said outer strands and said center strand.

14. The tension member according to claim 1 wherein said polymeric common coating encasing said plurality of cords is polyurethane.

15. A method of making the tension member of claim 1 comprising:

forming each of said plurality of cords, comprising:

(a) building said center strand and said outer strands;

(b) extruding said polymeric common coating around said center strand; and (c) positioning said outer strands around said common coating of said center strand;

positioning said plurality of cords so as to be substantially evenly spaced transversely and parallel to one another; and coating said cords in said polymeric common coating.

16. A method of making the tension member of claim 1 comprising:

forming each of said plurality of cords, comprising:

(a) building said center strand and said outer strands;

(b) pre-impregnating and curing said center strand with a thermoset material; and (c) positioning said outer strands around said center strand;

positioning said plurality of cords so as to be substantially evenly spaced transversely and parallel to one another; and coating said cords in said polymeric common coating.

* * * * *